United States Patent [19]

Kane

[11] Patent Number: 4,901,478

[45] Date of Patent: Feb. 20, 1990

[54] RADIAL DIAMOND ALIGNMENT APPARATUS FOR A LENS GENERATOR

[75] Inventor: William D. Kane, Bettendorf, Iowa

[73] Assignee: The United States Shoe Corporation, Cincinnati, Ohio

[21] Appl. No.: 176,665

[22] Filed: Mar. 31, 1988

[51] Int. Cl.[4] ..... B24B 13/005

[52] U.S. Cl. ..... 51/124 L; 51/165.75; 51/105 LG; 51/55

[58] Field of Search ..... 51/124 L, 165.75, 55, 51/284 R, 165.76, 165.81, 165.87, 105 LG, 106 LG, 33 W

[56] References Cited

U.S. PATENT DOCUMENTS

| | | | |
|---|---|---|---|
| 2,511,583 | 6/1950 | Heath et al. | 51/165.75 |
| 2,589,488 | 3/1952 | Fowler | 51/124 L |
| 2,806,327 | 9/1957 | Coburn | 51/124 L |
| 2,955,390 | 10/1960 | Phillips | 51/124 L |
| 3,289,355 | 12/1966 | Coburn et al. | 51/33 R |
| 3,685,210 | 8/1972 | Bowen | 51/124 L |

*Primary Examiner*—Robert Rose

*Attorney, Agent, or Firm*—Frost & Jacobs

[57] ABSTRACT

A lens generator for optical eyeglass lenses utilizes a carriage and gauge for adjusting and simultaneously measuring the radial displacement between a quill holder and a fixed location tailstock holding a lens blank. By quickly and accurately adjusting the radial displacement of the quill holder, different types of diamond wheels can be interchanged on the machine very quickly.

14 Claims, 2 Drawing Sheets

RADIAL DIAMOND ALIGNMENT APPARATUS FOR A LENS GENERATOR

TECHNICAL FIELD

This invention relates generally to optical lens generating machines and more particularly assemblies for such machines. The invention will be specifically disclosed in connection with an apparatus affixed to a lens generating machine for quickly and efficiently modifying the position of a quill to accommodate diamond wheels of different axial length.

BACKGROUND OF THE INVENTION

In the optical industry, prescription eyeglass lenses are typically conformed to a predetermined inside curve by sweeping a diamond grinding wheel across a lens blank. The diamond wheel generally has a hollow semi-spherical configuration and is rotated by a quill about an axis extending through the center of the semi-spherical diamond wheel. The quill is, in turn, rotatably supported on a number of adjustable slides that are adjusted to vary the sweep of the diamond wheel and to thus control the thickness and curvature of the generated lens.

In recent years, there has been increased consumer demand for lenses made not only from glass and CR-39 plastic material, but also from polycarbonate material. Polycarbonate material, for example, is often viewed as superior to glass and CR-39 plastic materials because it offers improved strength and durability with substantially reduced weight. Unfortunately, polycarbonate material requires a different type of diamond grinding wheels than does glass material, and the diamond wheels for polycarbonate material are generally shorter (axially) than diamond wheels for glass material. Consequently, unless more than one lens generating machine is used, it is necessary to change grinding wheels each time the operator changes between glass and polycarbonate lens blanks.

Due to tolerances, all grinding wheels are of slightly different (axial) length, even when the wheels are new. Furthermore, grinding wheels for glass material undergo substantially more wear than do grinding wheels for polycarbonate material. After experiencing some selected degree of wear, grinding wheels for glass material are frequently retrued, a procedure that further shortens (axially) the wheel. Thus, variations between the axial lengths of grinding wheels for glass and polycarbonate materials are typically increased over time as the wheels wear.

Thus, when a lens grinding machine is used to generate lenses of both glass and polycarbonate on a frequent interchangeable basis, it becomes necessary to frequently readjust the machine to compensate for the differing lengths of the different wheel types.

It generally requires an average time of one hour to change diamond wheels and recalibrate the distance between the diamond wheel and the lens blank. Hence, when the capability to alternate between glass and polycarbonate lenses on a rapid basis is required, it is necessary for a lens grinding laboratory to have two separate lens generating machines. This, of course, necessitates a substantial increase in capital expenditure over a single lens generating machine and requires additional floor space in the lens grinding laboratory.

It is also occasionally necessary to adjust the position of a diamond wheel for glass material in a lens generator to compensate for wear and retruing. In many systems, wheel wear and retruing compensation is accomplished in the same general manner as the previously described distance compensation for new polycarbonate wheels that are different length than diamond wheels for glass material. Specifically, the quick change diamond wheel is removed from the lens generating machine and placed on a gauge table. Once the diamond wheel wear is gauged, the quick change quill is disassembled and shims of appropriate size are placed on the quill to axially reposition the cutting face of the worn diamond wheel to the same relative machine position as original wheel cutting face.

In recognition of the above-mentioned disadvantages, one major manufacturer of lens generating machines has developed a system for changing diamond wheels in lens generating machines in slightly less than five minutes. In the system, known as the Quick Change Diamond System from Coburn Optical Industries, Inc. of Muskogee, Okla. the original quill for the lens generating machine is replaced with a quick change quill that, in essence, uses replaceable shims to axially increase or decrease the quill length. This permits an operator to quickly change a diamond wheel for polycarbonate material and a different diamond wheel for glass material. Furthermore, with such a quick change quill, the interface surfaces of the wheel for polycarbonate material is located at the same relative position on the machine as the corresponding surfaces for a diamond wheel for glass material.

Although the above described Coburn Quick Change Diamond System offers substantial advantages over earlier methods of changing diamond wheels, the time demands for changing diamond wheels and compensating for wear remains excessive, even under this improved system. These time demands are Particularly troublesome when the lens generating machines are being used in what the trade now refers to as "optical superstores" wherein the lens grinding laboratory is located in a high volume retail optical store and eyeglasses are provided to customers in a very short time, as, for example one hour or less.

SUMMARY OF THE INVENTION

Accordingly, it is a primary object of the invention to provide a lens generating machine having an apparatus for quickly compensating for changes in diamond wheel length.

It is another object of the invention to provide a lens generating machine capable of compensating for diamond wheel wear without disassembling the quill.

Yet another object of the invention is to provide an apparatus for simultaneously adjusting and measuring the relative positioning of a quill holder and a tailstock.

Additional objects, advantages, and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations pointed out in the appended claims.

To achieve the foregoing and other objects, and in accordance with the purposes of the present invention as described herein, an improved apparatus is provided for quickly adjusting the relative positioning of a quill holder and a lens chuck tailstock in a machine for generating a predetermined curvature on an optical eyeglass lens from a lens blank. The lens generating machine includes a base, a tailstock or other means for supporting an optical lens blank at a predetermined location relative to the base, a slide deck mounted on the base, a pivot pin, an arcuate way system for moving the slide deck about an arcuate path about the pivot pin, a quill holder mounted upon the slide deck, a quill rotatably mounted in the quill holder for rotating a grinding wheel, and an apparatus for adjusting and gauging the radial displacement of the quill holder relative to the pivot pin. The adjusting and gauging apparatus includes a radial way system for guiding radial displacement of the quill holder on the slide deck toward and away from the pivot pin. Means are also provided for accurately and bidirectionally effectuating controlled displacement of the the quill holder relative to the cross slide on the radial way system. A gauging means is provided for simultaneously measuring and visually displaying the radial displacement of the quill holder relative to the cross slide so that the relative radial position between the quill and pivot pin can be adjusted and measured simultaneously without disassembly of the quill holder.

In accordance with another aspect of the invention, the effectuating means includes a handle for manually displacing the quill holder relative to the slide deck.

According to another aspect of the invention, the effectuating means includes means for threadably advancing and retracting the quill holder relative to the slide deck in a radial direction.

In another aspect of the invention, the means for advancing and retracting the quill holder includes a threaded bore in the quill holder, the threaded bore extending in a direction toward the supporting means. A threaded member is also provided, a first end of the threaded -ember being threadably received by the bore.

According to a-other aspect of the invention, a first bracket is rigidly secured to the cross slide. The first bracket supports the threaded member at a location distal to the first end of the threaded member. Means are also provided for preventing radial movement of the threaded member relative to the first bracket so that rotation of the threaded member effectuates relative radial movement between the quill holder and the cross slide.

In another aspect of the invention, a second bracket is rigidly secured to the quill holder. The gauging means is rigidly secured to the second bracket and is movable with the quill holder.

Still another aspect of the invention includes the presence of a reference surface fixed relative to the cross slide. The gauging means is engagable with the reference surface for measuring displacement of the quill holder relative to the cross slide.

In one specific aspect of the invention, the reference surface is formed by a bracket rigidly secured to the cross slide.

In another specific aspect of the invention, the radial way system includes adjoining complementary dovetail surfaces on the quill holder and the cross deck.

In yet another aspect of the invention, the handle is secured to the second end of the threaded member and is operative to rotate the threaded member.

Still other objects of the invention will become readily apparent to those skilled in the art from the following description wherein there is shown a preferred embodiment of the invention, simply by way of illustration of one of the best modes contemplated for carrying out the invention. As it will be realized, the invention is capable of other different embodiments, and its several details are capable of modification in various, obvious aspects, all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the descriPtion serve to explain the principles of the invention. In the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
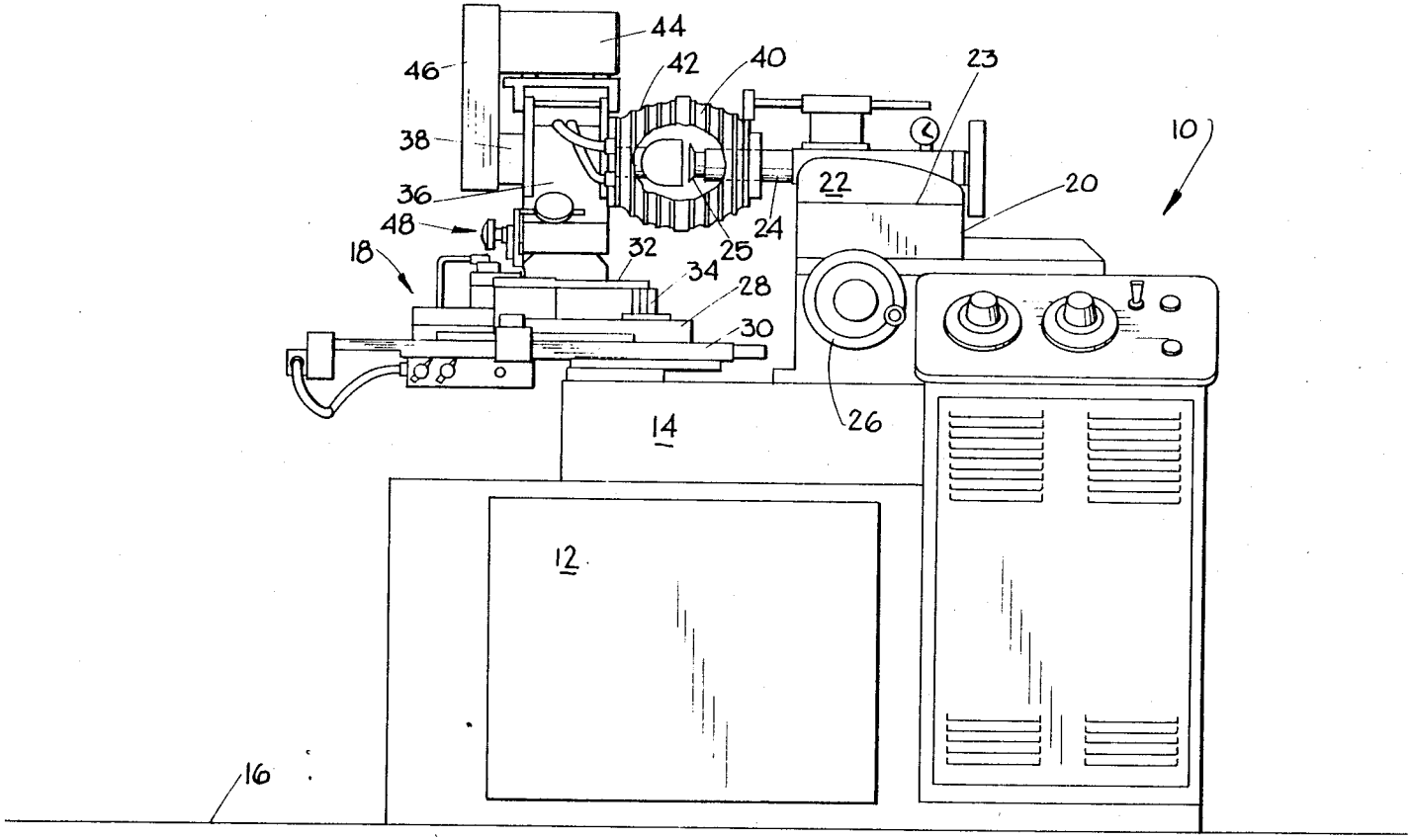
FIG. 1 is a front elevational view of a lens generator for producing prescription lenses utilizing one form of the present invention.

Reference is now made to FIG. 1 showing a lens generating machine, generally designated by the numeral 10, employing an adjusting and gauging apparatus constructed in accordance with the principles of the present invention. The illustrated lens generating machine 10 includes a subbase portion 12 supporting a base portion 14 in an elevated position above the level of a floor 16. The subbase portion 12 also housing a coolant system (not shown) for the machine 10. FIG. 1 also illustrates a control cabinet 11 for housing appropriate machine controls (not shown).

The base portion 14 supports both a deck slide and a tailstock, the deck slide and the tailstock being generally designated in depiction of FIG. 1 by the respective numerals 18 and 20. As those skilled in the art will readily appreciate, the tailstock 20 provides a means for supporting a lens blank at a fixed location determined by the thickness of the lens to be generated by the lens generating machine 10. This location is, of course, varied for different lens thicknesses. In the preferred embodiment, the tailstock 20 includes a carriage 22 that movably supports a chuck 24 for holding a lens blank 25 securely against grinding pressure. The carriage 22 is moved on a slide 23 of the tailstock 20 in the illustrated embodiment by a hand wheel 26. The carriage 22 is moved relative to the tailstock 20 to vary the thickness of a lens blank 25 supported on the chuck 24 as it is generated into a prescription lens by the lens generating machine 10.

The deck slide 18 includes a lower deck 28 slidably mounted to the base 14 on base slide 30. An upper deck 32 of the deck slide 18 is pivotally mounted to the lower deck 28 about a pivot pin 34 so as to permit relative arcuate movement between the lower and upper decks 28,32. A quill holder 36 is mounted on and movable with the upper deck 32. The quill holder 36 rotatably supports a quill 38 for rotating a diamond grinding wheel 40. The grinding wheel 40 is preferably operatively disposed in a coolant curtain 42 so as to protect the operator and the environment from splashing of coolant applied to the grinding wheel 40 during the grinding process. A motor 44 is used to rotate the quill 38 by a belt (not shown) located within a guard 46.

In accordance with the principles of the present invention, the quill holder 36 of the illustrated lens generating machine 10 is mounted on an apparatus, generally designated by the numeral 48, for axially adjusting and gauging displacement of the quill holder 36 relative to the pivot pin 34.

Figure 3:
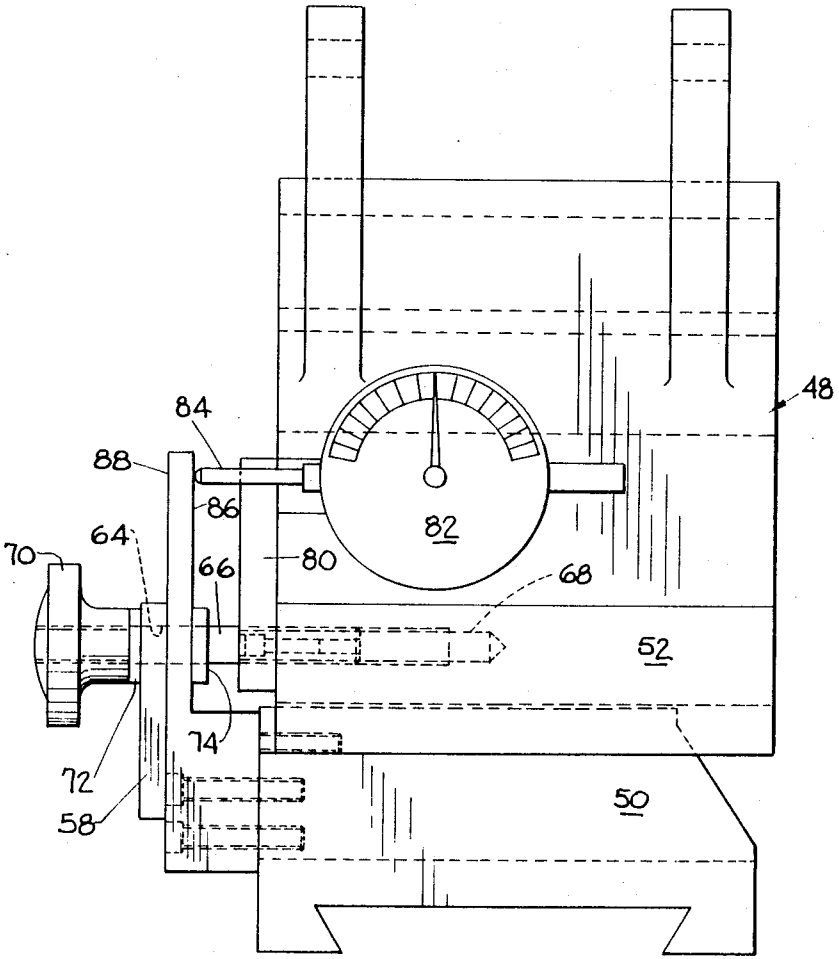
FIG. 3 is fragmentary front elevational view of the apparatus of FIG. 2.
Figure 2:
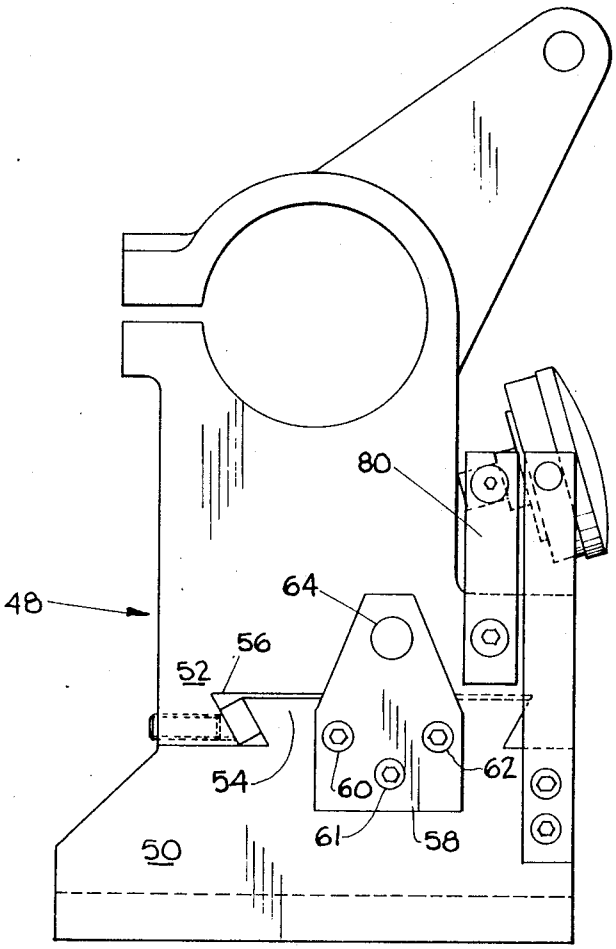
FIG. 2 is an end elevational view of the apparatus employed by the machine of FIG. 1 for controllably and bidirectionally displacing the quill holder relative to the cross slide.

Turning now to FIG. 3, the adjusting and gauging apparatus 48 is shown in greater detail. The apparatus 48 includes a quill riser 50 to which a quill holder carriage 52 is mounted. In the specific illustrated embodiment, the carriage 52 is integral to the quill holder 36. Obviously, however, an integral relationship between the carriage 52 and quill holder is not necessary if the two elements are secured together for common movement. As best seem in FIG. 2, there is a way system between the quill riser 50 and the carriage 52 for guiding the carriage 52 in a radial direction toward both the pivot pin 34 and the tailstock 20 (see FIG. 1) (For purposes of the present specification and claims, the term "radial" shall mean radial with respect to the pivot pin 34 unless the context indicates otherwise). In the illustrated embodiment, this way system takes the form of complementary dovetail surfaces on the adjoining surfaces 54,56 of the quill riser 50 and carriage 52 respectively. The quill riser 50 is also shown mounted upon the upper deck 32 by a dovetail way system. However, once the quill riser 50 is installed on the upper deck 32, it is rigidly secured thereto.

A first bracket 58 is rigidly secured to the quill riser 50 through the agency of three screws 60-62. This bracket 58 contains an aperture 64 for supporting a threaded member 66. A first end of the threaded member 66 extends into, and is threadably received by, a bore 68 in the carriage 52. The opposite end of the threaded member 66 is connected to a manual handle 70 that can be used to rotate the threaded member 66. The threaded member 66 is journaled in a pair of bushings 72 (only one of which is illustrated in the drawings) at the bracket 58, the bushings 72 being circumferentially disposed about the threaded member to support and reduce rotating friction of the the threaded member 66. A lock nut 74 is also circumferentially disposed about the threaded member 66 in abutting relationship with the first bracket 58, the lock nut being disposed on the axial side of the bracket 58 opposite the handle 70 and being operative to prevent radial movement between the bracket 58 and threaded member 66. Hence with the bracket 58 fixed to the quill riser, rotation of the handle 70 forces relative radial movement of the carriage 52 and the quill riser 50.

A second bracket 80 is secured to the carriage 52 and used to mount a gauge 82. The gauge 82 includes a plunger 84 for contacting a reference surface 86 fixed relative to the gauge base 50. In the quill riser illustrated embodiment, this reference surface 86 is formed by a bracket 88 rigidly secured to the quill riser 50. The gauge 82 provides a visual display of the gauged distance between the gauge, which is radially displaced with the carriage, and the reference surface which is fixed relative to the slide deck. This then enables an operator to rotate the handle 70 to bidirectionally displace the quill holder 36, and to simultaneously measure that displacement. Furthermore, since the threaded member 66 moves the carriage very precisely, precise measured radial displacements of the carriage can be effectuated very rapidly.

Among other advantages, it will be appreciated that the ability to quickly and accurately measure radial displacement of the quill holder 36 relative to the slide deck 32 permits rapid adjustment of the radial displacement between a quill holder and a pivot pin. Thus, diamond grinding wheels for glass material and polycarbonate material can be interchanged quickly by rotating the handle 70 to arrive at a predetermined gauge reading corresponding to the appropriate displacement for a specific grinding wheel. In this way, a single lens generating machine in an in-store lens grinding laboratory can be used for generating lens of different materials without incurring substantial time loss in changing from one type of grinding wheel to another.

Additionally, the adjusting and gauging apparatus of the invention -greatly minimizes the time required for compensating for diamond wheel wear and retruing. As those skilled in the art will readily surmize from the above description, wheel wear and retruing compensation can be achieved by merely rotating the handle 70. More specifically, a wheel set gage is secured about the pivot pin 34, and handle 70 is merely rotated until the wheel contacts a gage pin extending from the wheel set gage. Moreover, when such wheel wear and retruing compensation is made, the reading displaced on the gauge 82 when the wheel contacts the gage pin is then substituted for the predetermined gauge reading for the worn and/or retrued wheel whenever the worn and/or retrued wheel is subsequently installed on the lens generating machine 10.

In summary, numerous benefits have been described which result from employing the concepts of the invention. The invention provides for quick interchanging of different types of diamond wheels on a single lens generator by quickly and accurately adjusting the radial displacement between a quill holder and a pivot pin at a fixed location. Furthermore, the invention permits diamond wheel wear and retruing compensation by merely rotating a handle to move the quill holder to a position wherein the wheel contacts a gage pin.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. An apparatus for adjusting a quill of an optical lens generating machine, comprising:

a base;

means for supporting an optical lens blank at a predetermined location relative to the base;

a slide deck supported by said base;

a pivot pin;

means for arcuately moving the slide deck relative to the base about the pivot pin;

a quill riser mounted on the slide deck, said quill riser being movable relative to the slide deck about a first way system;

a quill holder supported by said quill riser;

a grinding tool;

a quill rotatably mounted in the quill holder for rotating the grinding tool;

a radial way system for guiding displacement between the quill holder and the quill riser, the quill holder being movable on the radial way system toward and away from the pivot pin;

means for accurately and bidirectionally effectuating controlled radial displacement of the quill holder relative to the quill riser on the radial way system; and gauging means for simultaneously measuring and visually displaying the relative radial displacement of the quill holder relative to the quill riser whereby the relative radial position between the quill holder and the quill riser can be adjusted and measured simultaneously.

2. An apparatus as recited in claim 1 wherein the effectuating means includes a handle for manually effectuating displacement of the quill holder relative to the slide deck.

3. An apparatus as recited in claim 1 wherein the effectuating means includes means for threadably advancing and retracting the quill holder relative to the slide deck in a radial direction.

4. An apparatus as recited in claim 3 wherein the means for advancing and retracting the quill holder includes a quill riser radially fixed with respect to slide deck, a carriage rigidly secured to the quill holder, the carriage being radially movable with respect to the quill holder, a threaded bore in the carriage, the threaded bore extending in a direction toward the supporting means, and further including a threaded member, a first end of the threaded member being threadably received by the bore.

5. An apparatus as recited in claim 4 further including a first bracket rigidly secured relative to the quill riser, the first bracket supporting the threaded member, and means (74) for preventing radial movement of the threaded member relative to the first bracket, whereby rotation of the threaded member effectuates relative radial movement between the quill holder and the quill riser.

6. An apparatus as recited in claim 5 further including a second bracket rigidly secured to the carriage, the gauging means being rigidly secured to the second bracket and being movable with the carriage.

7. An apparatus as recited in claim 6 further including a reference surface fixed relative to the slide deck, the gauging means being engagable with the reference surface for measuring displacement of the carriage relative to the slide deck.

8. An apparatus as recited in claim 7 wherein the reference surface is formed by a bracket rigidly secured relative to the quill riser.

9. An apparatus as recited in claim 8 wherein the radial way system includes adjoining complementary surfaces on the carriage and the quill riser.

10. An apparatus as recited in claim 9 wherein the handle is secured to the second end of the threaded member, the handle being operative to rotate the threaded member and to effectuate radial displacement between the carriage and the quill riser.

11. An apparatus as recited in claim 1 wherein the radial way system is substantially perpendicular to the first way system.

12. An apparatus as recited in claim 4 wherein the carriage is integral with the quill holder.

13. An apparatus as recited in claim 12 wherein the quill riser is movable relative to the slide deck.

14. An apparatus for adjusting a quill of an optical lens generating machine, comprising:

a base;

means for supporting an optical lens blank at a predetermined location relative to the base;

a slide deck supported by said base;

a pivot pin;

means for arcuately moving the slide deck relative to the base about the pivot pin;

a quill riser mounted on the slide deck;

a quill holder supported by said quill riser;

a grinding tool;

a quill rotatably mounted in the quill holder for rotating the grinding tool; and means for controllably adjusting the axial position of the quill relative to the quill riser to control the axial distance between the grinding tool and the quill riser.

* * * * *

UNITED STATES PATENT AND TRADEMARK OFFICE

CERTIFICATE OF CORRECTION

PATENT NO. : 4,901,478

DATED : February 20, 1990

INVENTOR(S) : Kane

It is certified that error appears in the above-identified patent and that said Letters Patent is hereby corrected as shown below:

Column 7, claim 4, line 37, delete "holder" and insert -- riser --.

Column 7, claim 5, line 45, after "member" insert -- at a location distal to the first end of the threaded member --.

Column 7, claim 5, line 46, after "means" delete "(74)".

Signed and Sealed this

Third Day of September, 1991

*Attest:*

*Attesting Officer*

HARRY F. MANBECK, JR.

*Commissioner of Patents and Trademarks*